US008408314B2

(12) United States Patent
Patel et al.

(10) Patent No.: US 8,408,314 B2
(45) Date of Patent: Apr. 2, 2013

(54) MULTI-POINT CHEMICAL INJECTION SYSTEM FOR INTELLIGENT COMPLETION

(75) Inventors: Dinesh R. Patel, Sugar Land, TX (US); Christopher Taor, Missouri City, TX (US); Kenneth Rohde, Richmond, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 166 days.

(21) Appl. No.: 12/843,944

(22) Filed: Jul. 27, 2010

(65) Prior Publication Data

US 2011/0079398 A1 Apr. 7, 2011

Related U.S. Application Data

(60) Provisional application No. 61/248,903, filed on Oct. 6, 2009.

(51) Int. Cl.
*E21B 34/06* (2006.01)
*E21B 43/22* (2006.01)

(52) U.S. Cl. ..... 166/373; 166/320; 166/306

(58) Field of Classification Search ..... 166/373, 166/320, 250.01, 222, 53, 205, 310, 268, 166/306, 297, 369, 387, 106
See application file for complete search history.

(56) References Cited

U.S. PATENT DOCUMENTS

| | | | | |
|---|---|---|---|---|
| 6,491,102 | B2 * | 12/2002 | Leismer et al. | 166/316 |
| 6,531,694 | B2 | 3/2003 | Tubel | |
| 6,668,936 | B2 | 12/2003 | Williamson | |
| 6,789,621 | B2 | 9/2004 | Wetzel | |
| 6,880,402 | B1 | 4/2005 | Couet | |
| 7,234,524 | B2 * | 6/2007 | Shaw et al. | 166/304 |
| 7,306,043 | B2 | 12/2007 | Toekje | |
| 2006/0096760 | A1 | 5/2006 | Ohmer | |
| 2006/0124318 | A1 * | 6/2006 | Sheffield | 166/381 |
| 2006/0231256 | A1 * | 10/2006 | Rivas et al. | 166/297 |
| 2006/0278399 | A1 | 12/2006 | Dwivedi | |
| 2008/0236842 | A1 | 10/2008 | Bhavsar | |
| 2009/0294123 | A1 * | 12/2009 | Mescall et al. | 166/250.01 |
| 2010/0101788 | A1 | 4/2010 | Mennem | |
| 2011/0297393 | A1 * | 12/2011 | Patel | 166/373 |

* cited by examiner

*Primary Examiner* — Daniel P Stephenson
(74) *Attorney, Agent, or Firm* — Brandon S. Clark

(57) ABSTRACT

An intelligent completion system includes production tubing configured for production from multiple zones in a wellbore. At least one flow control valve is disposed on the production tubing for each of the multiple zones, this flow control valve capable to regulate the flow of a wellbore fluid into the production tubing. A chemical injection mandrel is disposed on the production tubing adjacent the at least one flow control valve in the each of the multiple zones, this mandrel being connected to at least one chemical injection line for injecting one or more chemicals into the wellbore. A control mechanism is connected to the at least one flow control valve and the chemical injection mandrel such that the injection mandrel and the at least one flow control valve are operated in a coordinated manner.

24 Claims, 14 Drawing Sheets

MULTI-POINT CHEMICAL INJECTION SYSTEM FOR INTELLIGENT COMPLETION

CROSS REFERENCE TO RELATED APPLICATIONS

This claims the priority of provisional application Ser. No. 61/248,903, filed on Oct. 6, 2009. The disclosure of this provisional application is incorporated by reference in its entirety.

BACKGROUND OF INVENTION

1. Field of the Invention

The present invention relates generally to the downhole well operations, and more particularly to downhole chemical injection for intelligent completions.

2. Background Art

Hydrocarbon fluids such as oil and gas are produced from subterranean formations by drilling a well to penetrate the hydrocarbon-bearing formation. After drilling, the wells are typically completed with various devices downhole to facilitate the production of the hydrocarbons. In an intelligent completion system, various sensors, pumps, and flow control valves are included. In addition, an intelligent completion system may include fully automated measurement and control systems that optimizes reservoir economics without human intervention.

When a broad pay zone or multiple pay zones is completed, the intelligent completion system may include multiple production zones. FIG. 1 shows an example of two adjacent producing zones 10 and 12. The wellbore is cased with casing 16 that has perforations 18 and 19, respectively, in zones 10 and 12. A bottom hole assembly 11 includes an upper packer 13 and a bottom packer 14. There are an upper screen 15, a lower screen 17, and a zone isolation packer 10*a* separating zones 10 and 12. Annulus 11*a* is defined between the casing 16 and the tubing 12*a* and between packers 13 and 14.

When formation fluids from formations come into contact with a pipe, valve or other production equipment in a wellbore, or when there is a decrease in temperature, pressure, or change of other conditions, waxes and/or asphaltines in the formation fluids may precipitate or separate out. Over time, deposits such as scale, wax, or asphaltine, etc., may build-up on surfaces of downhole components and impede their function and/or efficiency. To address the issue of deposit build-up, chemicals may be injected into production tubing to remove, reduce or inhibit the deposit material inside the tubing or on downhole devices. For example, a control line may be run from the surface to an injection point located in the completion to convey the injected chemical downhole into a production stream. One common practice is to have one or more injection points provided upstream a production packer.

In intelligent completion well systems, multiple flow control valves are run to control the production from multiple zones. However, these various valves may not function in the event of scale build up around moving surfaces. Running control lines from the surface to remedy these situations may not be practical when multiple zones are included in a completion. Therefore, chemical injection systems suitable for preventing and/or reducing deposit build-up in intelligent completion are needed.

SUMMARY OF INVENTION

One aspect of the invention relates to intelligent completion systems. An intelligent completion system in accordance with one embodiment of the invention includes a production tubing configured for production from multiple zones in a wellbore; at least one flow control valve disposed on the production tubing for each of the multiple zones, wherein the at least one flow control valve regulates flow of a wellbore fluid into the production tubing; a chemical injection mandrel disposed on the production tubing adjacent the at least one flow control valve in the each of the multiple zones, wherein the chemical injection mandrel is connected to at least one chemical injection line for injecting one or more chemicals into the wellbore; and a control mechanism connected to the at least one flow control valve and the chemical injection mandrel such that the injection mandrel and the at least one flow control valve are operated in a coordinated manner.

Another aspect of the invention relates to methods for removing or reducing a deposit or buildup on a downhole device in an intelligent completion having multiple production zones. A method in accordance with one embodiment of the invention includes: opening a flow control valve disposed on a production tubing, wherein the opening simultaneously activates a chemical injection mandrel disposed the production tubing adjacent the flow control valve in the same zone; injecting at least one chemical using the chemical injection mandrel; and allowing the at least one chemical to flow pass the flow control valve.

Other aspects and advantages of the invention will be apparent from the following description and the appended claims.

DETAILED DESCRIPTION

Figure 1:
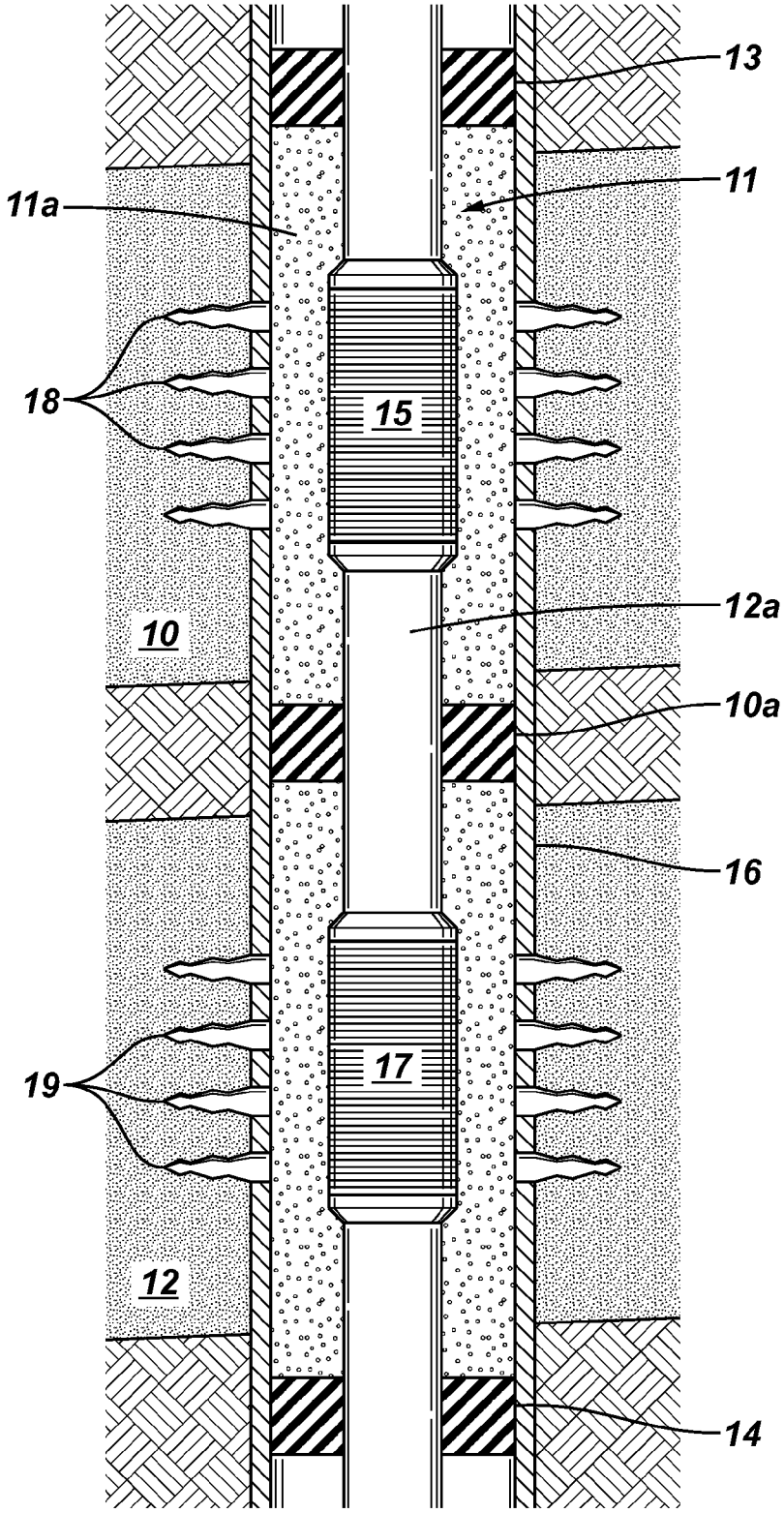
FIG. 1 (Prior Art)
FIG. 1 shows a conventional multi-zone completion in a wellbore.

Embodiments of the invention relate to systems and methods for removing or preventing buildups on downhole devices in intelligent completion systems in multi-zone wellbores. Embodiments of the invention may be used for multi-point chemical injections in multi-zone intelligent completions on land or offshore. One of ordinary skill in the art would appreciate that embodiments of the invention may also be used with other types of completions with proper modifications and variations.

Some embodiments of the invention relate to multi-point chemical injection systems for use with multi-zone intelligent completions. These chemical injection systems may be used to prevent deposits or buildups of wax, scale, etc. Such buildups may interfere with the proper operations or efficiencies of various downhole devices, such as pumps or flow control valves. By injecting chemicals into the production streams upstream of such devices (e.g., flow control valves), these chemical additives will be carried by the production streams to flow through (or flow by) the particular devices, thereby dissolving the undesirable buildups or preventing the formation of such buildups.

The type of chemicals used with embodiments of the invention may vary with the conditions to be remedied or prevented (paraffins, scales, etc.). For example, for asphaltene buildups, the injected chemical may be aromatic compounds, such as toluene, kerosene, or naphtha. For paraffin buildups, the injected chemical may be xylene or toluene. For hydrate buildups, the injected chemical may be surfactants (e.g., polyvinylcaprolactum) or methanol. For scale buildups, the injected chemical may be EDTA (ethylene tetraacetic acid) or HCl (hydrochloric acid). The above-described are examples used for illustration only and are not meant to be exhaustive.

In accordance with embodiments of the present invention, chemical injection systems may be configured to be operated with existing controls that are already present in an intelligent completion. Such controls may be hydraulic controls or electrical controls. For example, hydraulic control (open and close) lines are typically included in intelligent completions to control flow control valves in various zones. By sharing the existing control mechanisms in intelligent completions, embodiments of the invention may be easily incorporated into any intelligent completion systems. Furthermore, using such systems, chemical injections may be synchronized with the operation of the flow control valves—i.e., chemical injection will be shut off when the flow control valves in a given zone are closed, and chemical injection will be performed only when the flow control valves are opened.

In the following description, numerous details are set forth to provide an understanding of the present invention. However, it would be appreciated by those skilled in the art that the present invention may be practiced without these details and that numerous variations or modifications from the described embodiments may be possible without departing from the scope of the invention.

Figure 2:
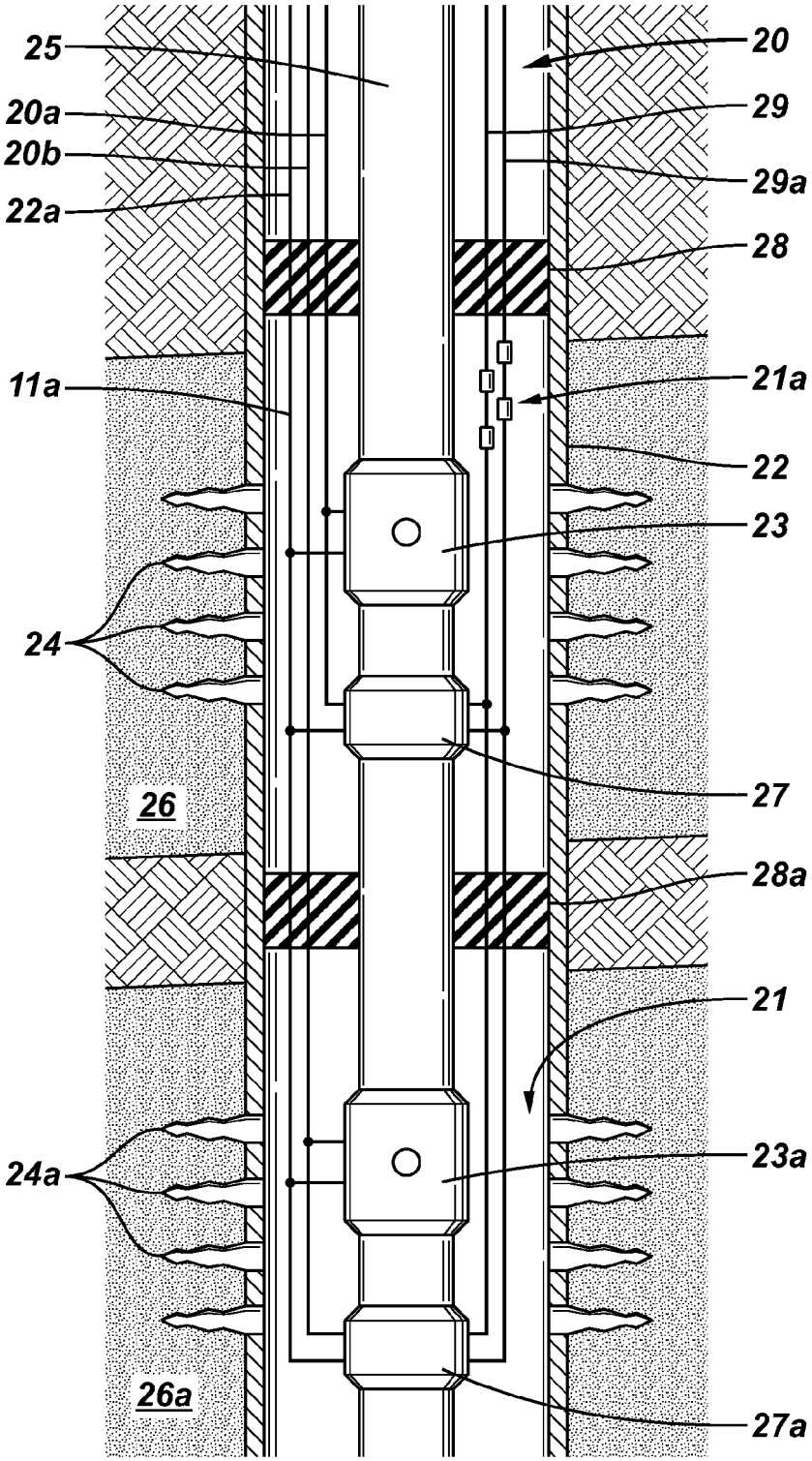
FIG. 2 shows a schematic illustration of a chemical injection system for a multi-zone intelligent completion according to an embodiment of the invention.

FIG. 2 shows an example of a chemical injection system for use with a multi-zone intelligent completion according to an embodiment of the invention. The wellbore 21 may be cased with a casing 22 having perforations to communicate with formation perforations 24, 24*a* in production zones 26, 26*a*, respectively. The production zones 26, 26*a* may be isolated by packers, such as a production packer 28 and a zone isolation packer 28*a*.

In a typical intelligent completion, one or more flow control valves may be included in each production zone. For example, as shown in FIG. 2, flow control valves 23 and 23*a* are provided on the production tubing 25 in the production zones 26 and 26*a*, respectively. These flow control valves can be used to regulate which zone produces the hydrocarbons, and they also can be used to regulate the flow rates.

These flow control valves are typically controlled by hydraulic control lines, though some are controlled by electrical means. For example, as shown in FIG. 2, three hydraulic control lines are illustrated. Separate "close" control lines 20*a* and 20*b* are individually connected to the flow control valves 23 and 23*a*, respectively. In addition, a common "open" line 22*a* is connected to both flow control valves 23 and 23*a*. The operations of these valves, for example, may be controlled by the pressure differentials between the "close" and "open" lines attached to each specific flow control valve. For example, all flow control valves attached to the "open" control line 22*a* may be opened, when this "open" control line 22*a* is pressurized. However, any individual valve may be closed by applying a similar pressure (to negate the pressure differential) to the specific "close" control line attached to that particular flow control valve. Therefore, individual flow control valves can be independently regulated in an intelligent completion system.

In accordance with embodiments of the invention, multi-point chemical injection systems may be designed to take advantage of these existing flow control mechanisms in an intelligent completion, thereby minimizing the engineering challenge and costs. In some intelligent completion, the flow control valves may be regulated by electrical means. In that situation, embodiments of the invention can also take advantage of the existing electrical controls to minimize the engineering challenge and costs. For clarity, the following description will use hydraulic controls to illustrate embodiments of the invention. However, one skilled in the art would appreciate that embodiments of the invention may also be used with electrical controls.

As shown in FIG. 2, a chemical injection system 20 in accordance with one embodiment of the invention may include injection mandrels 27, 27*a* attached to the production tubing 25 adjacent the flow control valves 23, 23*a*. Each of the injection mandrels 27, 27*a* may be connected to one or more chemical injection lines (two chemical injections lines 29, 29*a* are shown in this example).

In accordance with embodiments of the invention, if more than one chemical injection line is connected to an injection mandrel, these multiple chemical injection lines may be separately injected by the injection mandrel or they may be comingled in the injection mandrel before these chemicals are injected into a wellbore. A proper metering device may be attached to each chemical injection line and/or an outlet of the chemical injection mandrel. In addition, one or more check valves may be used with each chemical injection line to prevent backflow of fluids. For example, each chemical injection lines 29 and 29*a* is provided with double check valves 21*a* in the example shown in FIG. 2.

In accordance with some embodiment of the invention, chemical injections are preferably performed in a manner coordinated with the operation of the flow control valves in the in the respective zones, e.g., chemical injection is only performed in the zone where the flow control valve is open. This coordinated manner of operation can avoid wasting chemicals into the wellbore when the flow control valve in that zone is not open.

FIG. 2 shows a chemical injection system in accordance with one embodiment of the invention, wherein chemical injection may be synchronized with the opening of a flow control valve. As shown, hydraulic close line 20*a* is connected to both the flow control valve 23 and the injection mandrel 27, while hydraulic close line 20*b* is connected to both the flow control valve 23*a* and the injection mandrel 27*a*. A common open line 22*a* is connected to all flow control valves 23, 23*a* and all injection mandrels 27, 27*a*.

This configuration allows for regulation of the injection mandrels 27 and 27*a* to be in sync with regulation of the adjacent flow control valves 23 and 23*a*, respectively. That is, the injection mandrel 27 operates only when the flow control valve 23 is open, and the injection mandrel 27*a* operates only when the flow control valve 23*a* is open. The term "in sync" or "synchronization" refers to the state of coordinated operation of the flow control valves and chemical injections in a particular zone; it does not require the opening or closing of the valves to occur at exactly the same time. Due to different configurations of various valves and the nature of hydraulic operations, a small lag time may occur for one valve or injection mandrel relative to the other.

As noted above, one or more chemical injection lines may be connected to one injection mandrel. In addition, if more than one chemical injection line is attached to a mandrel, these chemical injection lines may be separated injected by the mandrel. Alternatively, these chemical injection lines may be comingled in the mandrel before they are injected into a wellbore. The following description will use some examples to illustrate embodiments of the invention. One of ordinary skill in the art would appreciate that these examples are for illustration only and are not intended to limit the scope of the invention.

EXAMPLE 1

The first example illustrates a chemical injection system according to one embodiment of the invention, wherein two or more chemical injection lines (e.g., chemical A and chemical B) are comingled prior to being injected into a wellbore by an injection mandrel.

FIGS. 3-6 illustrate various states of operations of such a chemical injection system, together with the operations of flow control valves, in multi-zone operations. For this illustration, a chemical injection system is shown having two chemical injection lines and two injection mandrels for operation in two production zones (zone 1 and zone 2) separated by a zone isolation packer. A person of ordinary skill in the art would appreciate that embodiments of the present invention may be used with any suitable number of chemical injection lines in any suitable number of zones.

Figure 3:
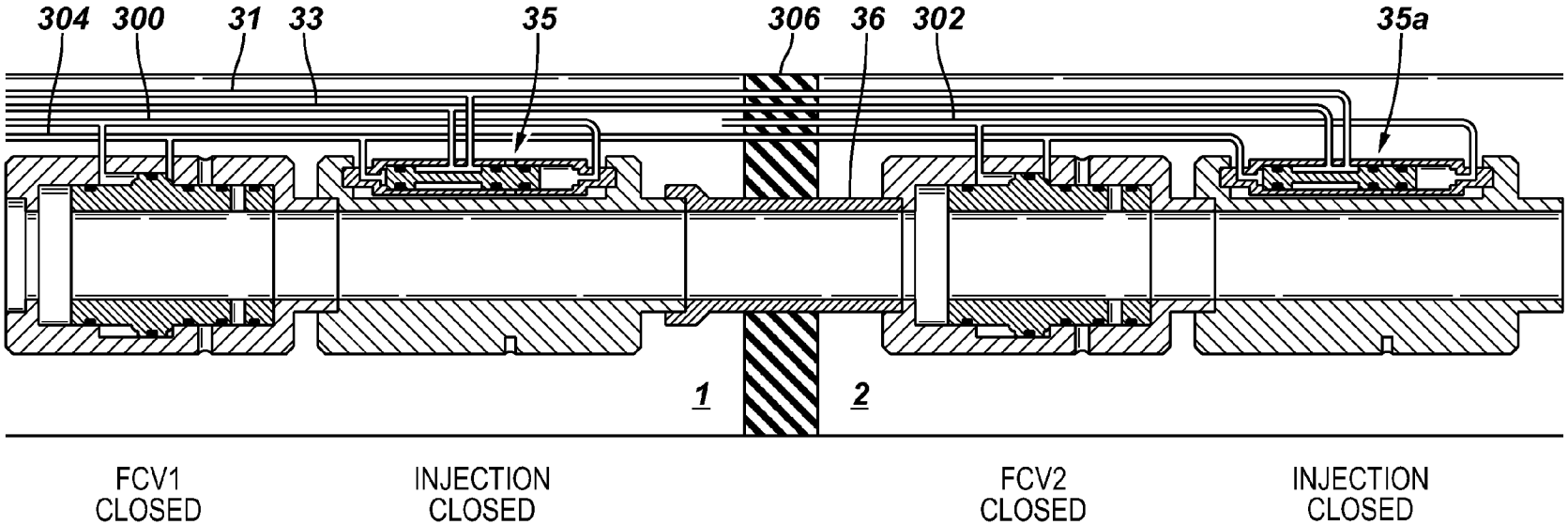
FIG. 3 shows a schematic illustration of an operational state of an intelligent completion with a chemical injection system according to an embodiment of the invention.

The chemical injection system shown in FIG. 3 includes a first chemical injection line 31 and a second chemical injection line 33 connected to a first injection mandrel 35. Chemicals from the first chemical injection line 31 and the second chemical injection line 33 may be mixed in the first injection mandrels 35. Similarly, the first chemical injection line 31 and the second chemical injection line 33 may be connected with a second injection mandrel 35*a*. Chemicals from the first chemical injection line 31 and the second chemical injection line 33 may be mixed in the second injection mandrel 35*a*.

The chemicals from the two chemical injection lines may be mixed inside a chamber in each of the injection mandrels. The injection mandrels include outlets for injecting these chemicals into wellbores. The inlets (from the chemical injection lines) and/or outlets on the injection mandrel may include metering valves. Specific operation states of this chemical injection system are illustrated as follows.

FIG. 3 shows a state of the chemical injection system, in which flow control valves (FCV1 and FCV2) and chemical injection mandrels 35,35*a* are closed in both zones 1 and 2, which are separated by a zone isolation packer 306. In this state, wellbore fluids in zone 1 and zone 2 may not enter the production tubing 36 and chemicals would not be injected into the wellbore. This may be a "resting" state, in which both zones are not producing.

The "resting" state may be achieved when all hydraulic control lines are not pressurized, i.e., all hydraulic control lines are bled off. Therefore, the pressure differential between the "open" and "close" lines connecting to each flow control valve or injection mandrel is negligible (or zero) and, therefore, all valves are closed.

Figure 4:
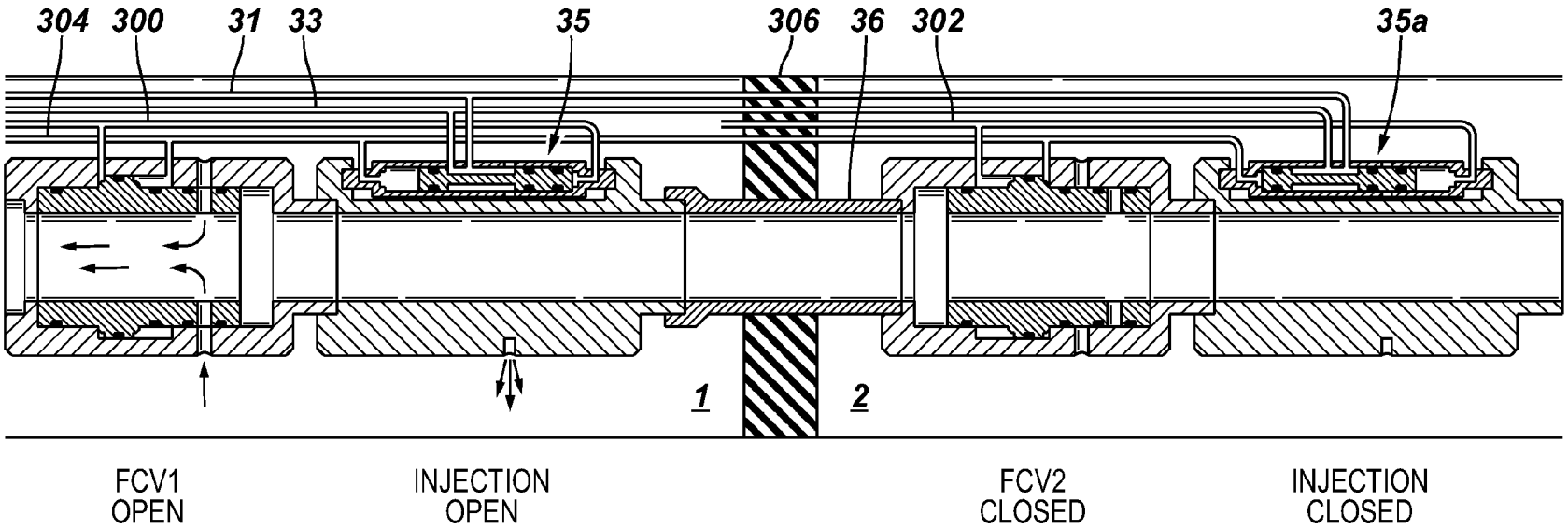
FIG. 4 shows a schematic illustration of another operational state of an intelligent completion with a chemical injection system according to an embodiment of the invention.

FIG. 4 shows a state of the chemical injection system, in which the zone 1 is in production, while zone 2 is not. In this state, the first flow control valve (FCV1) is open and the first mandrel 35 is operational. This allows the chemicals from the first and second chemical injection lines 31,33 to be injected into the wellbore in zone 1. These chemicals then mix with the wellbore fluids and enter through the first flow control valve (FCV1) into the production tubing 36. While these chemicals passing through the first flow control valve (FCV1), these chemicals may remove or prevent any buildups on the FCV1. in addition, these chemicals may lubricate the FCV1.

This state may be accomplished by applying pressure on both the open control line 304 and the second close control line 302, while allowing the first close line 300 to remain bled off (i.e., low or no pressure). Under these conditions, the pressure differential between the control lines 304 and 302 is small or non-existent, while the pressure differential between control lines 304 ad 300 is substantial (or over a threshold). Therefore, only devices (FCV1 and second injection mandrel 35) connected to control line 300 are operational.

Figure 5:
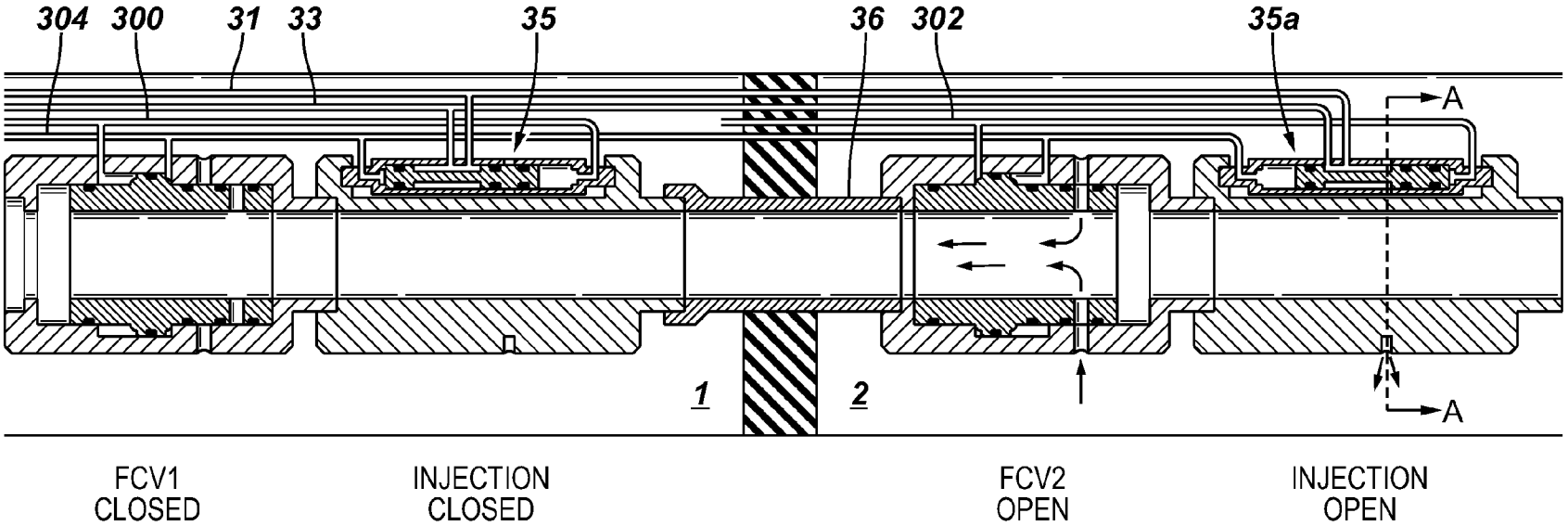
FIG. 5 shows a schematic illustration of another operational state of an intelligent completion with a chemical injection system according to an embodiment of the invention.

FIG. 5 shows another state of the chemical injection system, in which zone 2 is producing, while zone 1 is not. This may allow the chemicals to be injected into the wellbore in zone 2. Then, wellbore fluids in zone 2 will mix with the injected chemicals prior to passing through FCV2 and entering the production tubing 36. While passing through FCV2, the injected chemical can help prevent or remove buildups on FCV2.

This state may be accomplished by applying pressure on both the open control line 304 and the first close control line 300, while allowing the second close line 302 to remain bled off (i.e., low or no pressure). Under these conditions, the pressure differential between the control lines 304 and 300 is small or non-existent, while the pressure differential between control lines 304 ad 302 is substantial. Therefore, only devices (FCV2 and second injection mandrel 35*a*) connected to control line 302 are operational.

Figure 6:
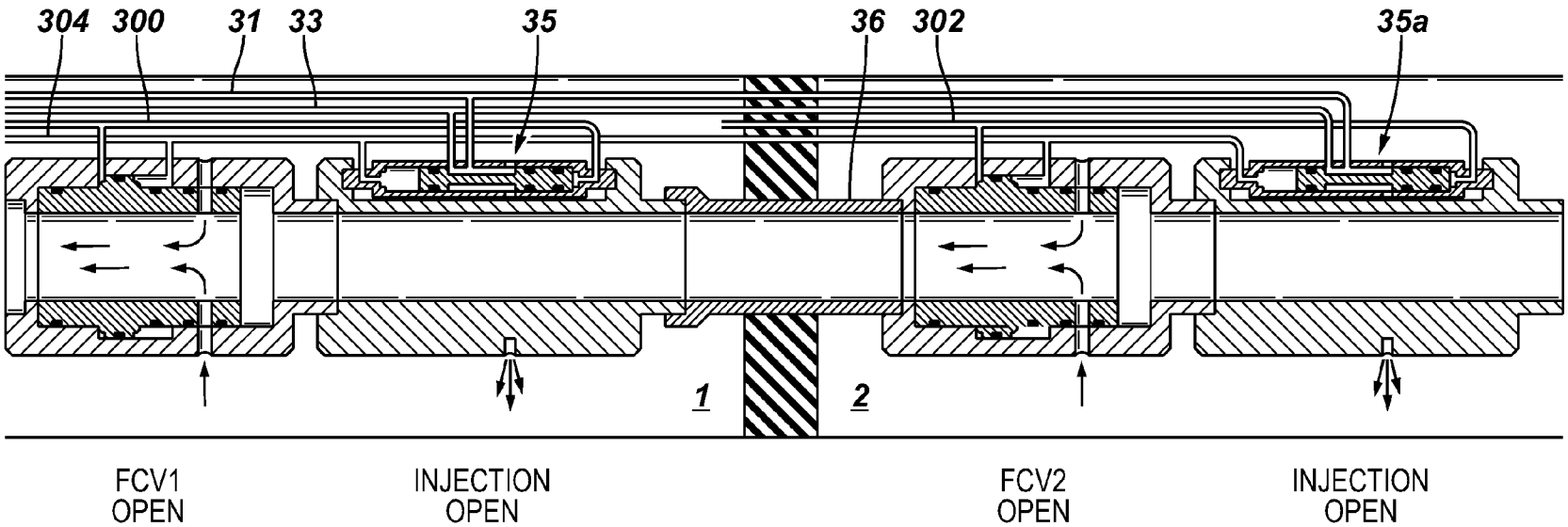
FIG. 6 shows a schematic illustration of another operational state of an intelligent completion with a chemical injection system according to an embodiment of the invention.

FIG. 6 shows another state of the chemical injection system, in which both zones 1 and 2 are in production. This state allows the injected chemicals to flow pass both flow control valves FCV1 and FCV2, thereby removing or preventing harmful buildups on these valves.

This state may be accomplished by applying pressure on the open control line 304, while keeping the first and the second close control lines 300, 302 in the bled-off state.

EXAMPLE 2

The above example uses a chemical injection system that comingles different chemicals in the injection mandrel. In accordance with some embodiments of the invention, injection mandrels can also be designed to allow for independent injection of different chemicals without comingling.

For example, FIGS. 7-10 show a chemical injection system capable of independent chemical injections without comingling. In this illustration, a chemical injection system may have two chemical injection lines 31,33 connected to two mandrels 35,35*a* for operation in two production zones (zone 1 and zone 2) separated by a zone isolation packer 306. Two chemical injection lines are for illustration only. A person of ordinary skill in the art would appreciate that embodiments of the present invention may include any suitable number of chemical injection lines.

As noted above, each of the chemical injection lines 31,33 may contain one or more check valves. In addition, each of the chemical injection lines 31,33 may be independently connected to separate chambers 70,72 in the first injection mandrels 35 and to separate chambers 70*a*,72*a* in the second injection mandrel 35*a*, respectively. Thus, chemicals from the chemical injection lines 31,33 may be kept separate inside the injection mandrels, which may then inject these chemicals via independent outlets into wellbores.

In addition, hydraulic controls lines 300, 302, and 304 are connected to the two flow control valves (FCV1, FCV2) and two mandrels 35,35*a*, as in the embodiment shown in FIG. 3. These hydraulic control lines are used to operate the flow control valves and the mandrels in a manner known in the art—e.g., the valves are open when the hydraulic lines connected to that particular device have a pressure differential exceeding a threshold.

Figure 7:
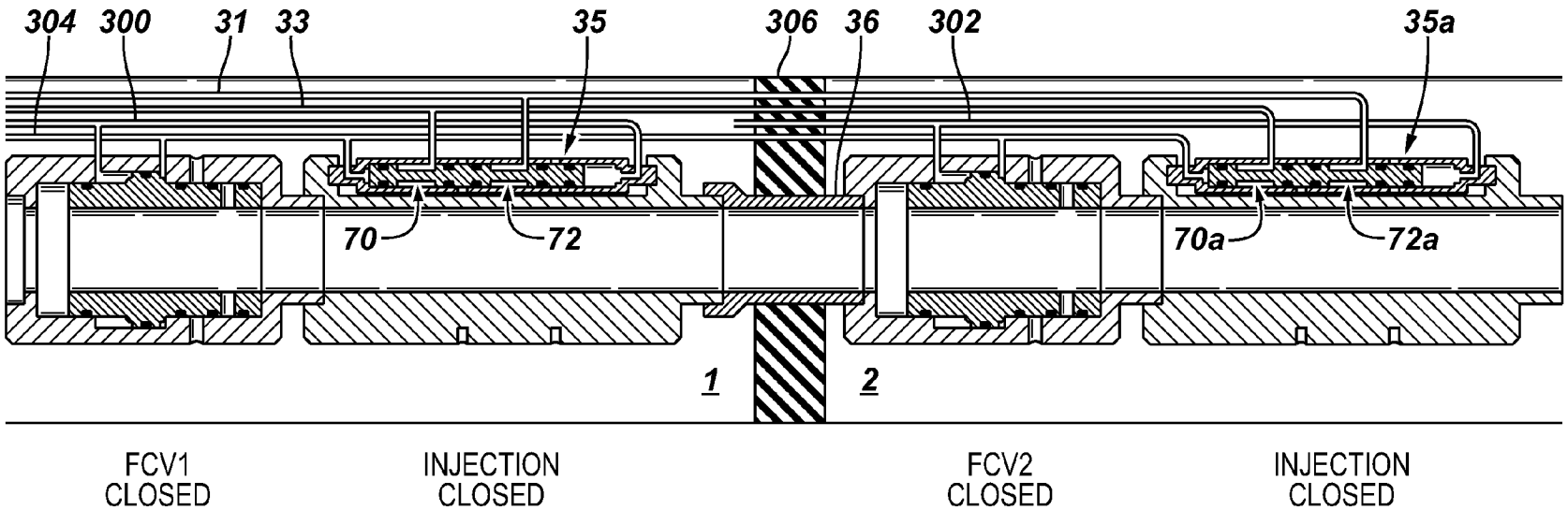
FIG. 7 shows a schematic illustration of another operational state of an intelligent completion with a chemical injection system according to an embodiment of the invention.

FIG. 7 shows a state of the chemical injection system, in which all flow control valves are closed and all chemical injection mandrels are not activated in zones 1 and 2. In this state, wellbore fluids in zone 1 and zone 2 may not enter the production tubing 36 and the chemicals would not be injected into the wellbore. This may be a "resting" state. This resting state, for example, may be achieved by not applying any pressure in all hydraulic control lines—i.e., all hydraulic control lines are bled off.

Figure 8:
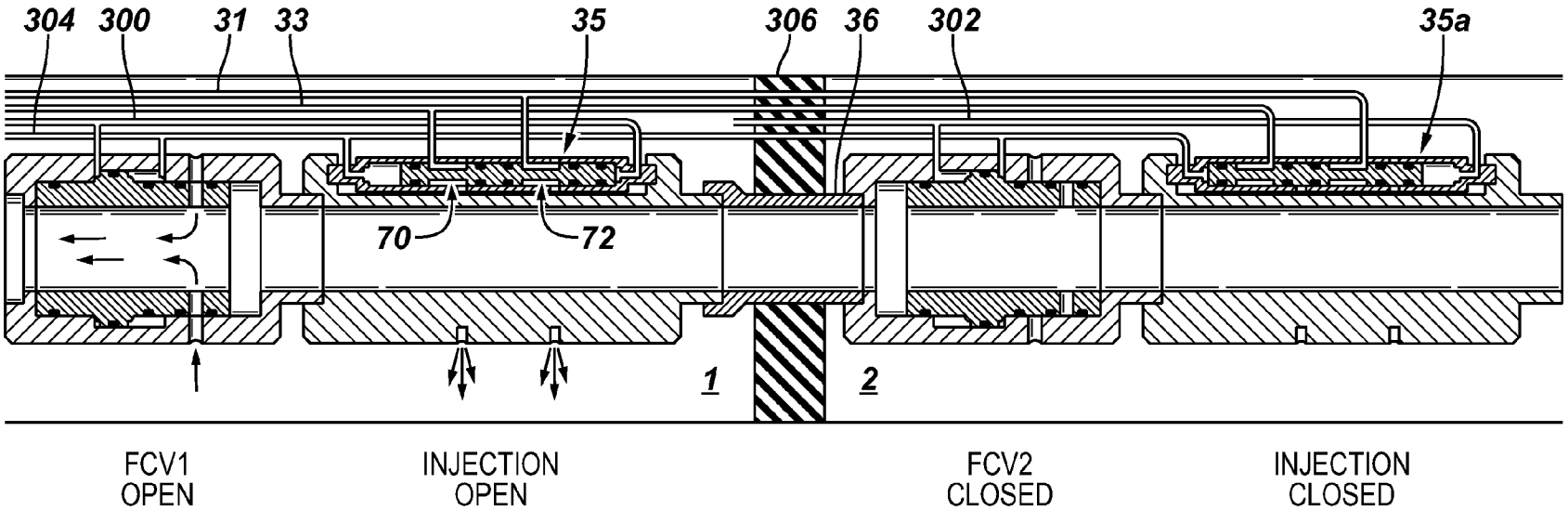
FIG. 8 shows a schematic illustration of another operational state of an intelligent completion with a chemical injection system according to an embodiment of the invention.

FIG. 8 shows another state of the chemical injection system, in which zone 1 is in operation, whereas zone 2 is shut. This may allow the chemicals in chambers 70,72 in the first injection mandrel 35 to be injected into the wellbore. The injected chemicals will mix with wellbore fluids in zone 1, pass through the flow control valve FCV1 and enter the production tubing 36. These chemicals may help to remove or prevent buildups on the FCV1.

This state may be accomplished by applying pressure to the open control line 304 and the second hydraulic close line 302, while allowing the first hydraulic close line 300 to remain bled off.

Figure 9:
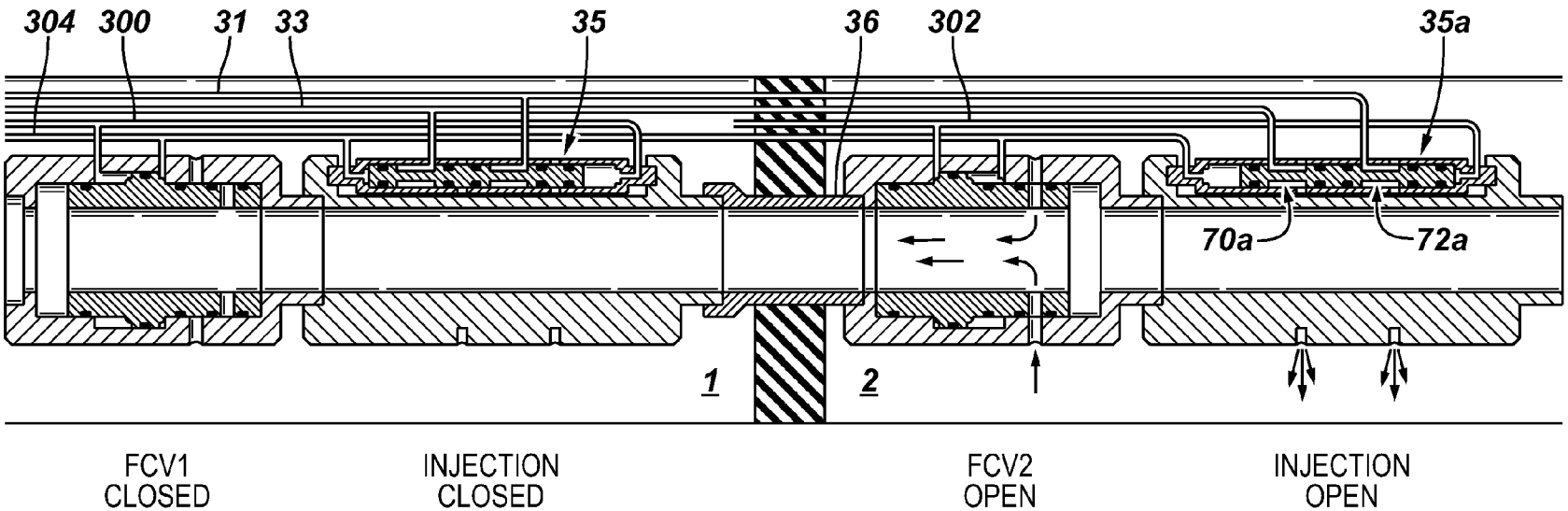
FIG. 9 shows a schematic illustration of another operational state of an intelligent completion with a chemical injection system according to an embodiment of the invention.

FIG. 9 shows another state of the chemical injection system, in which zone 2 is producing, whereas zone 1 is shut. This may allow the chemicals in the chamber 70*a*,72*a* in the second injection mandrel 35*a* to be injected into the wellbore. The injected chemicals will mix with the wellbore fluids in zone 2 and pass through FCV2 prior to entering the production tubing 36, thereby helping to remove or prevent buildups on FCV2.

This state may be accomplished by applying pressure to the open control line 304 and the first hydraulic close line 300, while allowing the second hydraulic close line 302 to remain bled off.

Figure 10:
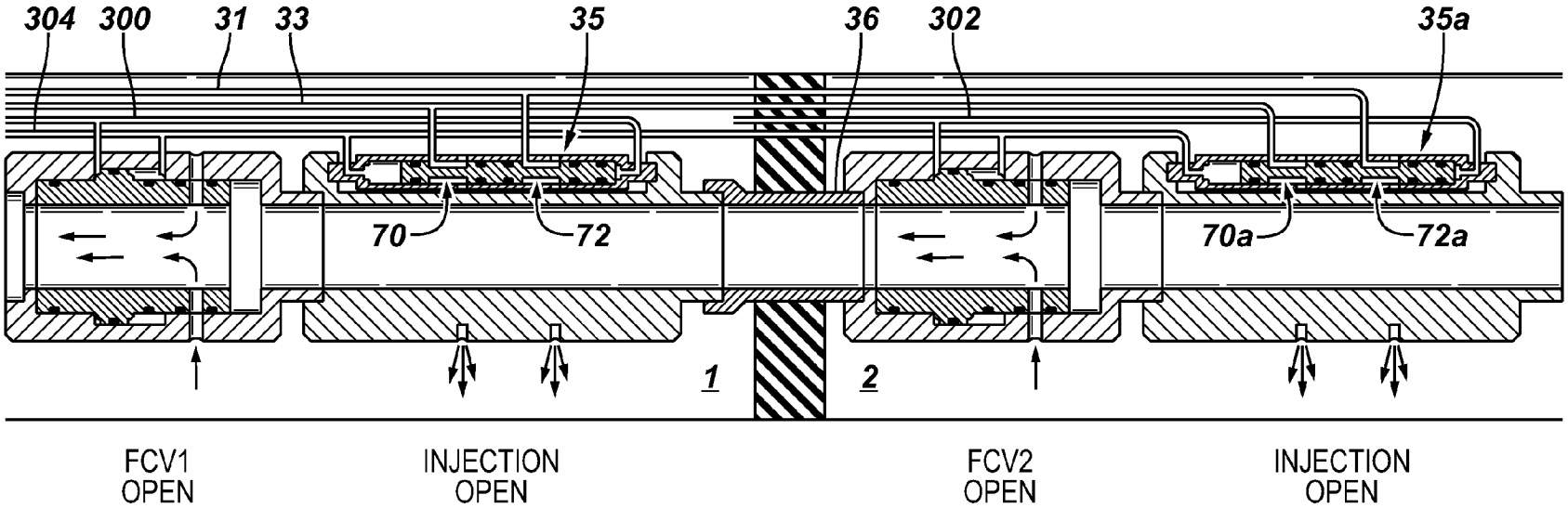
FIG. 10 shows a schematic illustration of another operational state of an intelligent completion with a chemical injection system according to an embodiment of the invention.

FIG. 10 shows another state of the chemical injection system, in which both zone 1 and zone 2 are producing. This state may allow the chemicals to be injected by mandrels 35,35*a* into the wellbore. The injected chemicals will mix with wellbore fluids in zone 1 and zone 2 and pass through FCV1 and FCV2 prior to entering the production tubing 36, thereby helping to remove or prevent buildups on FCV1 and FCV2.

This state may be accomplished by applying pressure to the open control line 304, while allowing the first and the second hydraulic close lines 300, 302 to remain bled off.

Figure 11A:
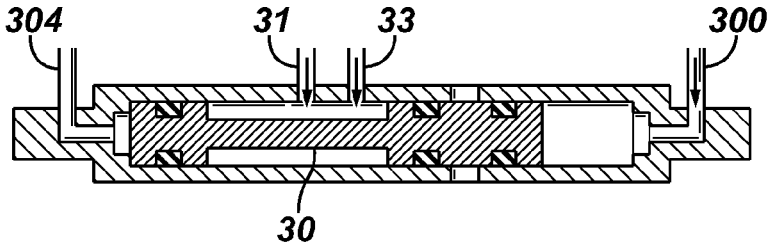
FIGS. 11(A)-11(D) show examples of chemical injection mandrels that can be used with embodiments of the invention and their open and closed states.
Figure 11B:
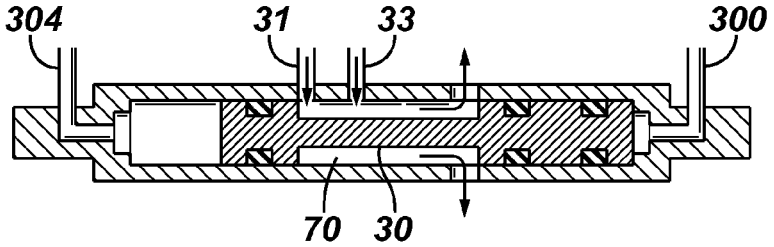

Injection mandrels for use with embodiments of the invention may be any suitable injection mandrel known in the art, such as those using piston control valves. For example, FIG. 11(A) and FIG. 11(B) illustrate a single chamber mandrel in the closed and open states, respectively. The open and closed states can be controlled by the relative pressure of the control lines 300 and 304 to push the piston 30 (to the right or left as shown in the figure). As shown, chemical injections lines 31 and 33 are connected to the same chamber 70 in the mandrel. Such an injection mandrel will comingle the chemicals before injecting it into a wellbore.

Figure 11C:
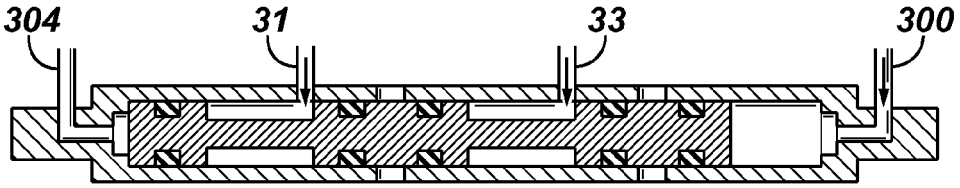
Figure 11D:
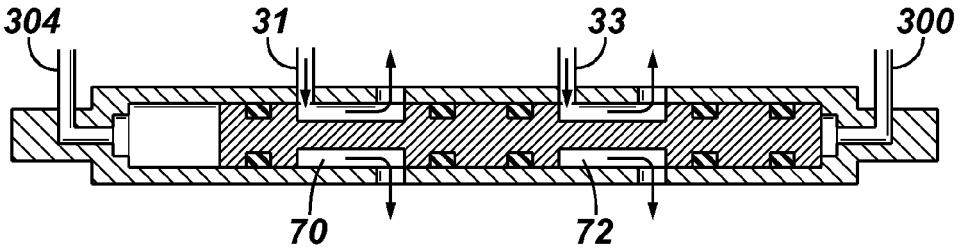

FIG. 11(C) and FIG. 11(D) illustrate an injection mandrel having separate chambers for the injection chemicals in the closed and open states, respectively. As shown, chemical injection line 31 is connected to chamber 70, while chemical injection line 33 is connected to chamber 72. Such an injection mandrel will not comingle the chemicals before injecting it into a wellbore.

Figure 12A:
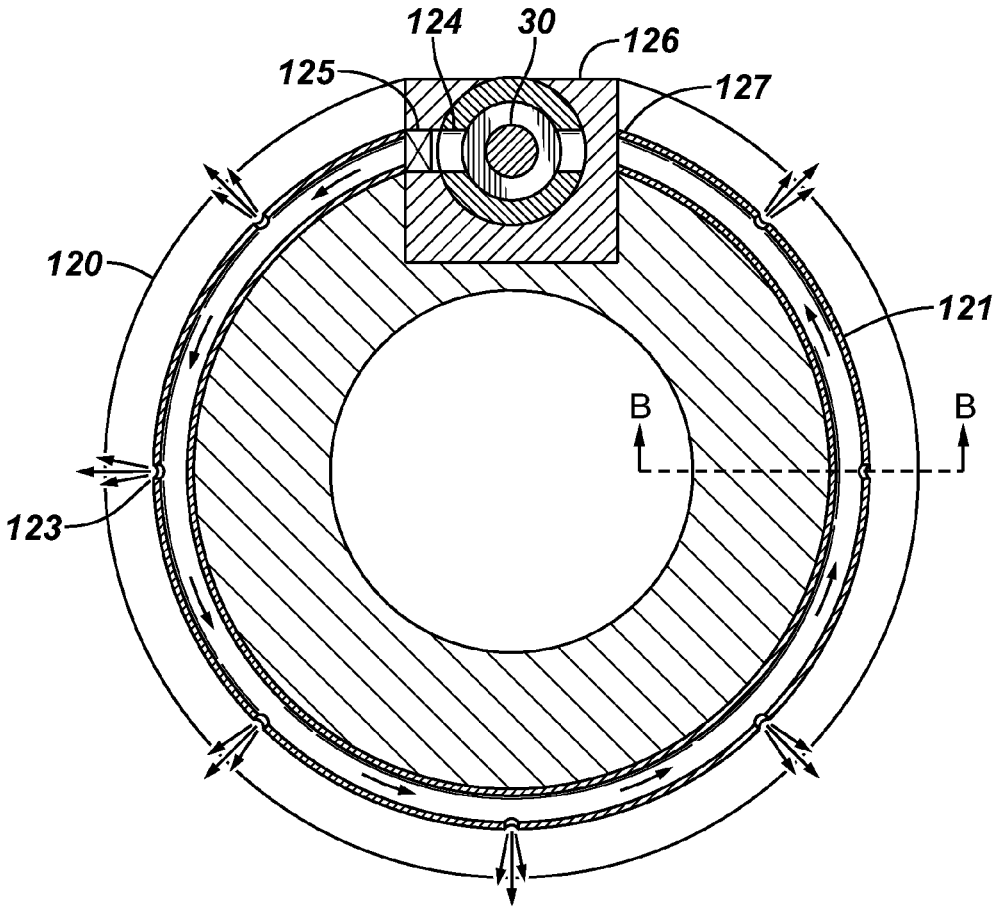
FIG. 12A shows a cross-section view of a chemical injection mandrel along line AA in FIG. 5 according to an embodiment of the invention.

The injection mandrels may be configured to inject chemicals in any desired configurations. For example, an injection mandrel may output the fluids into a conduit that is disposed around the circumference of the tool body and a number of orifices may be provided on this conduit, as illustrated in FIG. 12A. Such a configuration helps to distribute the injected chemicals around the wellbore in many azimuthal directions.

Figure 12B:
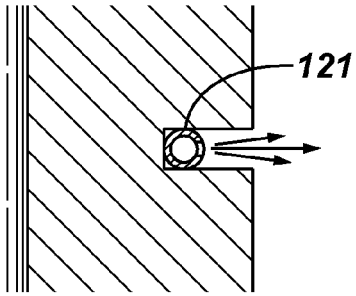
FIG. 12B shows a cross-section view along line BB in FIG. 12A.

FIG. 12A shows a cross-section view along the AA line in FIG. 5, and FIG. 12B shows a cross-section view along the BB line in FIG. 11A. As shown in FIG. 12A, a mandrel 120 may have a piston 30 operable by hydraulic systems to open and close the chemical outlet 124 in an injection block 126. The opening of the outlet 124 may allow the chemicals to flow from the chamber through a conduit 121 along the circumference of the mandrel 120. The conduit 121 may have a plurality of orifices 123 and a chemical outlet port 127. The chemicals may be injected into the wellbore through the plurality of orifices 123. The amount and the flow rate of the injected chemicals may be controlled by a metering valve 125, for example disposed at the outlet 124. The metering valve 125 may be a constant flow metering valve or any suitable metering devices.

Figure 13:
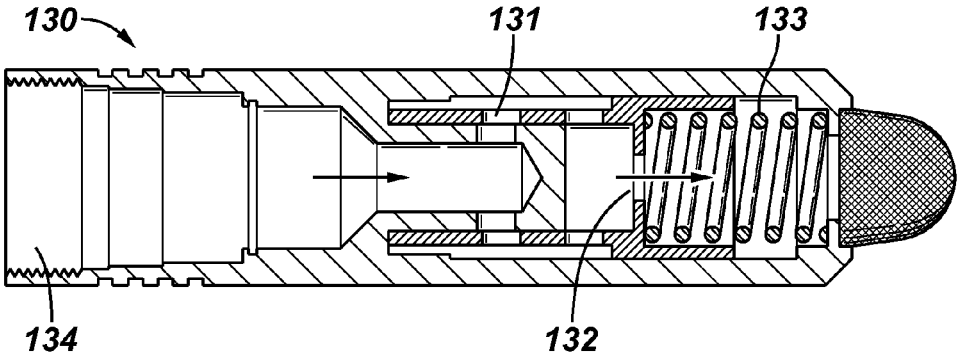
FIG. 13 (Prior Art)
FIG. 13 shows a cross-section view of a constant flow metering valve that can be used with embodiments of the invention.

Any suitable metering valves may be used with embodiments of the invention. For example, FIG. 13 shows an example of a constant flow metering valve 130 that is commercially available from the Lee Company (Westbrook, Conn.). This constant flow metering valve 130 includes a variable orifice 131 and a constant orifice 132, which rests against a spring 133. If more pressure is applied from the inlet 134, the spring 133 will be compressed, resulting in smaller opening at the variable orifice 131. On the other hand, when less pressure is applied from the inlet 134, the spring 133 can expand and push the variable orifice 131 to open up more. As a result, such a valve can provide a relatively constant flow, regardless of the pressure variations.

EXAMPLE 3

While embodiments illustrated above are capable of distributing the injected chemicals around the wellbore in a relative even fashion, sometimes thorough mixing of the injected chemicals with the wellbore fluids is desired. In this case, embodiments of the invention, as illustrated above, may be further equipped with one or more flow mixing devices.

Figure 14:
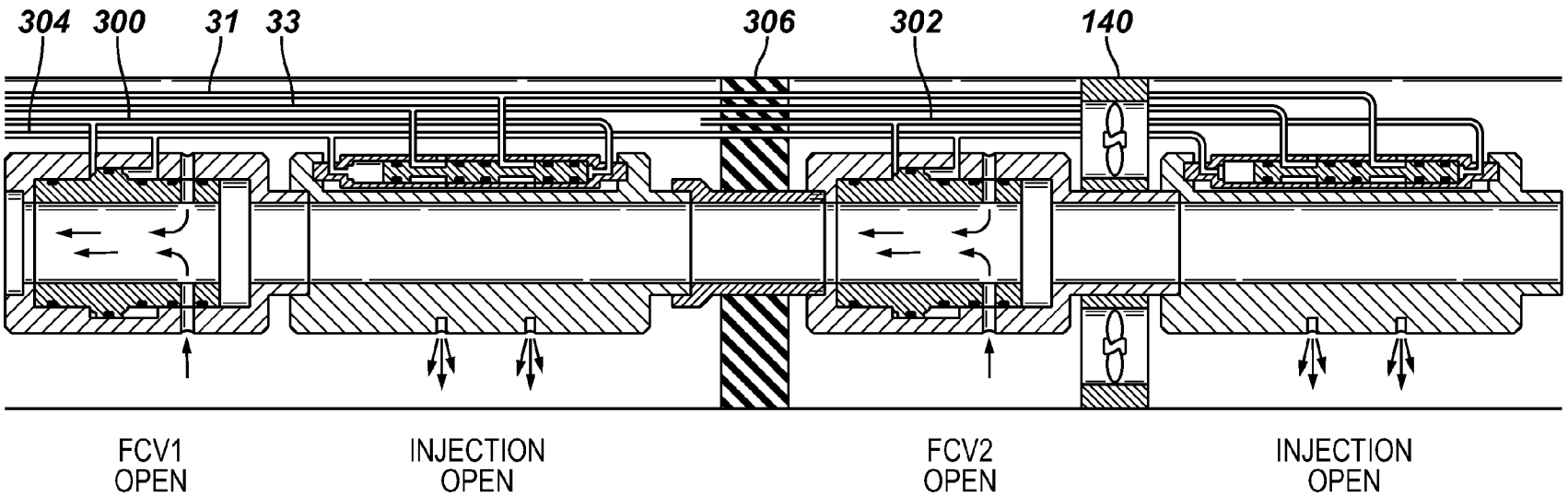
FIG. 14 shows an intelligent completion with a chemical injection system and a mixing device according to one embodiment of the invention.

For example, FIG. 14 shows a chemical injection system in accordance with an embodiment of the invention that includes one or more mixing devices. The chemical injection system is similar to the one shown in FIGS. 7-10, but with additional flow mixing devices 140. While this illustration shows that the mixing devices 140 are only provided in zone 2, one skilled in the art would appreciate that other modifications and variations are possible without departing from the scope of the invention.

Some embodiments of the invention relate to methods for reducing or removing deposits or buildups on downhole tools or devices.

Figure 15:
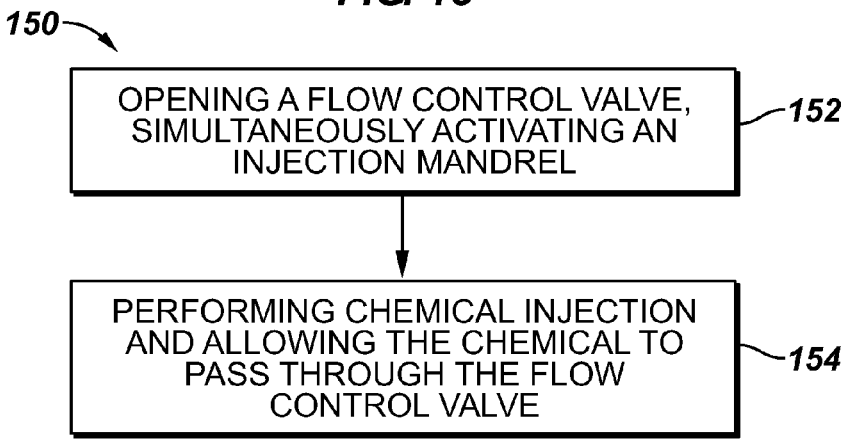
FIG. 15 show a method of removing or reducing buildups on a downhole device in accordance with one embodiment of the invention.

FIG. 15 shows a method for reducing or removing deposits or buildups on downhole tools or devices in accordance with one embodiment of the invention. The method 150 may include the step 152 of opening a flow control valve, which simultaneously activates an adjacent injection mandrel. When the flow control valve is opened, perform chemical injections and allow the injected chemicals to pass through a flow control valve (step 154).

Advantages of embodiments of the invention may include one or more of the following. Systems and methods of the invention may be used to prevent deposits and chemicals build-up in intelligent completion wells, where multiple flow control valves are run to control the production from multiple zones. The chemical injection systems may be designed to use the existing control mechanism, thereby reducing the engineering challenges and costs. In accordance with some embodiments of the invention, chemical injections are performed only when the flow control valves in the same zones are open. This helps to prevent waste of chemicals when they are not needed. Thus, embodiments of the invention may provide cost- and time-saving ways to ensure clean and functional valves used in intelligent completion well systems.

While the invention has been described with respect to a limited number of embodiments, those skilled in the art, having benefit of this disclosure, will appreciate that other embodiments can be devised which do not depart from the scope of the invention as disclosed herein. For example, the hydraulic control described above may be replaced with an electrical control mechanism. In that case, the hydraulic lines illustrate in the drawings may be replaced with electrical control lines (wires). Accordingly, the scope of the invention should be limited only by the attached claims.

The invention claimed is:

1. An intelligent completion system, comprising:

a production tubing configured for production from multiple zones in a wellbore;

at least one flow control valve disposed on the production tubing for each of the multiple zones, wherein the at least one flow control valve regulates flow of a wellbore fluid into the production tubing;

a chemical injection mandrel disposed on the production tubing adjacent the at least one flow control valve in the each of the multiple zones, wherein the chemical injection mandrel is connected to at least one chemical injection line for injecting one or more chemicals into the wellbore;

a control mechanism connected to the at least one flow control valve and the chemical injection mandrel such that the injection mandrel and the at least one flow control valve are operated in a coordinated manner; and a mixing device disposed adjacent the chemical injection mandrel or the at least one flow control valve.

2. The system of claim 1, wherein the at least one chemical injection line comprises a check valve.

3. The system of claim 1, wherein the control mechanism comprises a hydraulic mechanism having a plurality of hydraulic control lines.

4. The system of claim 1, wherein the control mechanism comprises an electrical control mechanism.

5. The system of claim 1, wherein the coordinated manner is such that chemical injection mandrel is operational only when the at least one flow control valve in the same zone is open.

6. The system of claim 1, wherein the chemical injection mandrel comprises a metering valve.

7. The system of claim 6, wherein the metering valve is a constant flow valve.

8. The system of claim 1, wherein the at least one chemical injection line comprises two or more lines connected to the chemical injection mandrel.

9. The system of claim 8, wherein the two or more lines are connected to a chamber in the chemical injection mandrel such that chemicals from the two or more lines are comingled in the chamber.

10. The system of claim 9, further comprising a mixing device disposed adjacent the chemical injection mandrel or the at least one flow control valve.

11. The system of claim 8, wherein the two or more lines are independently connected to different chambers in the chemical injection mandrel.

12. The system of claim 11, further comprising a mixing device disposed adjacent the chemical injection mandrel or the at least one flow control valve.

13. An intelligent completion system, comprising:

a production tubing configured for production from multiple zones in a wellbore;

at least one flow control valve disposed on the production tubing for each of the multiple zones, wherein the at least one flow control valve regulates flow of a wellbore fluid into the production tubing;

a chemical injection mandrel disposed on the production tubing adjacent the at least one flow control valve in the each of the multiple zones, wherein the chemical injection mandrel is connected to at least one chemical injection line for injecting one or more chemicals into the wellbore, wherein the at least one chemical injection line comprises two or more lines connected to the chemical injection mandrel; and a control mechanism connected to the at least one flow control valve and the chemical injection mandrel such that the injection mandrel and the at least one flow control valve are operated in a coordinated manner.

14. The system of claim 13, wherein the at least one chemical injection line comprises a check valve.

15. . The system of claim 13, further comprising a mixing device disposed adjacent the chemical injection mandrel or the at least one flow control valve.

16. The system of claim 13, wherein the control mechanism comprises a hydraulic mechanism having a plurality of hydraulic control lines.

17. The system of claim 13, wherein the control mechanism comprises an electrical control mechanism.

18. The system of claim 13, wherein the coordinated manner is such that chemical injection mandrel is operational only when the at least one flow control valve in the same zone is open.

19. The system of claim 13, wherein the chemical injection mandrel comprises a metering valve.

20. The system of claim 19, wherein the metering valve is a constant flow valve.

21. The system of claim 13, wherein the two or more lines are connected to a chamber in the chemical injection mandrel such that chemicals from the two or more lines are comingled in the chamber.

22. The system of claim 21 further comprising a mixing device disposed adjacent the chemical injection mandrel or the at least one flow control valve.

23. The system of claim 13, wherein the two or more lines are independently connected to different chambers in the chemical injection mandrel.

24. The system of claim 23, further comprising a mixing device disposed adjacent the chemical injection mandrel or the at least one flow control valve.

* * * * *